US006510944B2

(12) United States Patent
Chang

(10) Patent No.: US 6,510,944 B2
(45) Date of Patent: Jan. 28, 2003

(54) METHOD OF MAKING GOLF BAGS AND GOLF BAGS MADE BY SAME

(75) Inventor: I-Teh Chang, Kowloon (HK)

(73) Assignee: Ya Ling Chan, Kowloon (HK)

( * ) Notice: Subject to any disclaimer, the term of this patent is extended or adjusted under 35 U.S.C. 154(b) by 0 days.

(21) Appl. No.: 09/768,572

(22) Filed: Jan. 25, 2001

(65) Prior Publication Data

US 2002/0096444 A1 Jul. 25, 2002

(51) Int. Cl.[7] ..... A63B 55/06
(52) U.S. Cl. ..... 206/315.6; 211/70.2
(58) Field of Search ..... 206/315.6, 315.2–315.8; 211/70.2; 150/159, 160

(56) References Cited

U.S. PATENT DOCUMENTS 2,751,955 A * 6/1956 Nahon ..... 206/315.4
4,753,344 A * 6/1988 Antonious ..... 206/315.3
5,482,160 A * 1/1996 Stephen ..... 135/125
5,638,954 A * 6/1997 Hsien ..... 206/315.3
5,662,058 A * 9/1997 Wang ..... 112/475.08
5,725,095 A * 3/1998 Beck et al. ..... 206/315.3
5,918,737 A * 7/1999 Kwon ..... 206/315.3

* cited by examiner

*Primary Examiner*—Stephen P. Garbe
*Assistant Examiner*—Lien Ngo
(74) *Attorney, Agent, or Firm*—Burns, Doane, Swecker & Mathis, L.L.P.

(57) ABSTRACT

A golf bag having a substantially rigid top member, a substantially rigid bottom member, a plurality of rigid stays separating said top and bottom members, an outer cover and at least one internal partitioning member including: at least one intermediate member attached to one end of said plurality of stays and at least one internal partitioning member, said at least one intermediate member attached to either and top or bottom member, a distal end of said plurality of stays and said at least one internal partitioning member from said at least one intermediated member attached directly, or indirectly, the bottom or top member respectively.

16 Claims, 7 Drawing Sheets

METHOD OF MAKING GOLF BAGS AND GOLF BAGS MADE BY SAME

FIELD OF THE INVENTION

The present invention relates to a method of making golf bags and golf bags made by using such a method. More particularly, the present invention relates to golf bags having longitudinal internal partitions or dividers and a method of making such golf bags.

BACKGROUND OF THE INVENTION

Golf is a very popular outdoor sporting game which is played on a golf course. A typical golf course has 18 holes with an average yardage of about 5,000 meters which a golfer has to cover in order to complete all the holes in a normal way. Golf courses having 9, 36 and 72 holes are common variations of a standard golf course which are provided to suit players of different standards and demands and the yardage is usually proportional to the number of holes. In playing a golf game, different golf clubs, for example, woods, irons and putters, are usually required to impart an optimal drive to the ball and to hit the golf ball towards and into a hole during the various phases of a golf game.

Golf clubs are usually kept together in a golf bag for easy storage and convenient transport to and from courses and between holes. Golf bags are usually designed to allow easy and quick retrieval of the various clubs during a game. A typical golf bag is an elongate bag with a rigid moulded top collar and a closed moulded bottom member at its longitudinal ends together with a circumferential enclosure extending between the top collar and the bottom member. The top collar is usually supported from the bottom member by a plurality of rigid stays which are usually distributed around the edge of the bottom member and which are typically rigid plastic posts extending between the top collar and the bottom member.

Golf clubs are usually stored in a golf bag with club heads protruding from the top collar and handles resting on the upper surface of the bottom member. To avoid the handles from rocking about in the bottom of a golf bag during transportation or from entangling with each other which may cause damage, breakage or undesirable scratches, good golf bags are always formed with a number of small compartments which are small enough to limit excessive and undesirable movement of the clubs. The compartments are preferably formed by flexible partitioning or divider straps which are taut and which extend between the top collar and the bottom member of a golf bag. To provide for a framework of the compartments, a grid of rigid ridges which defines the peripheral walls of the compartments is usually formed within the aperture defined by the top collar. Flexible straps made for example of fabrics, nylon or polyester are preferred because they are light and friendly to the shafts of golf clubs. However, golf bags with such partitioning straps or dividers are difficult to form within a golf bag because of the elongate shape of a golf bag and because of their light and flexible characteristics. In general, golf bags with light and flexible partitioning straps are usually made by one of the two more commonly known methods.

In the first commonly known method, flexible and light dividing straps having a length approximately equal to the length of the golf bag are first attached to the upper surface of the bottom member. The attachment may, for example, be by direct sewing of one end of the dividing strap onto the upper surface of the bottom member or by first sewing one end of the straps to a rigid intermediary plate. The intermediary plate, on which there are already sewn a plurality of strap ends, is then attached to the upper surface of the bottom member. The strap ends are usually attached to the bottom member in a manner so that the straps, when connected to the ridges formed on the top collar member, will form a plurality of peripheral walls of the compartments which are generally parallel to the longitudinal axis of the golf bag.

Each of the strap ends which are not attached to the bottom member are preferably provided with a piece of cushioning material which forms an extension to the strap ends. The cushioning material is sized, shaped and cut so that it can fully wrap around the ridges on the top collar member and form a protective cushioning on both sides of the ridges to protect the club shafts from agitating with the hard ridges. The cushioning member is usually provided with pressure fastening means, for example, a pair of Velcro® fastener, so that the cushioning member can be secured onto the ridges on the top collar member with the ridges enclosed by the cushioning member and that the partitioning straps will be taut after the cushioning members have been properly wrapped around and secured underneath the ridges.

However, there are several known shortcomings of this method. Firstly, the preferred strap members are light and flexible with a width that is comparable to the width of a golf bag, the strap ends may be caught inside the golf bag when a semi-finished golf bag is placed up-side-down in order to recover the cushioned strap ends by gravity for securing onto the ridges. Secondly, the flexible straps will also easily get entangled with each other and it may be difficult to identify the correct strap end which corresponds to a particular ridge. Thirdly, as the overall cushioning formed on the top collar is formed by a collection of individually formed cushioning members, there are unsightly gaps between adjoining cushioning members which are not compatible with the expected appearance of a good quality and expensive golf bag.

In the second known method, the ridges are firstly and fully wrapped with a cushioning material which are sewn together so that unsightly gaps between adjoining branches of individual cushioning members are minimised. Flexible straps which are similar to that described in the first known method above are attached with one of the ends to the edge of the cushioning members which are underneath the ridges. The longitudinal edges of all the flexible straps are preferably joined together with the other longitudinal end connected to a rigid intermediary plate so that all the flexible straps can be joined to the moulded bottom member with a small number of fastening means. To provide for an intermediate alignment between the rigid intermediary plate and the corresponding bottom member, a plurality of positioning means, for example, pieces of sticky tape, placed at corresponding positions on the upper surface of the bottom member and the lower surface of the rigid intermediary plate, are provided. After the intermediary plate has been temporarily positioned, the intermediary plate and the flexible compartments will be permanently affixed onto the bottom member by riveting or other appropriate means. However, as the partitioning straps are very light and flexible and the bottom member is located at a distance away from the top collar, forming the temporarily positioning alignment is not easy and this procedure can be relatively time-consuming. Furthermore, a relatively bulky riveting machine having a riveting arm of a length comparable to the length of a golf bag would be required to rivet the intermediary plate permanently onto the bottom member.

Hence, it is desirable that an improved method for forming partitioning straps within an elongate golf bag can be provide to alleviate the shortcomings associated with the known methods.

OBJECTION OF THE INVENTION

It is therefore an object of the present invention to provide an improved method of forming partitioning straps within an elongate golf bag so that the shortcomings associated with known methods of making such golf bags can be alleviated. To provide makers or manufacturers of partitioned golf bags with an alternative or useful choice of the method of making the same is also an object of the present invention.

SUMMARY OF THE INVENTION

According to the present invention, there is provided a method of making a golf bag in which the golf bag includes a first and a second substantially rigid moulded end members disposed at the longitudinal ends of said golf bag, the method includes combining and fastening a first and a second intermediate sub-assembly wherein said first intermediate sub-assembly includes a first moulded end member, an intermediate member, a plurality of rigid stay members extending between said first moulded member and said intermediate member and at least a flexible partitioning strap between said first moulded end member and said intermediate member, and said second intermediate sub-assembly includes a second moulded end member and an enclosure having a first and a second longitudinal open ends wherein said first open end of said enclosure is connected to said second moulded member and said second end of said enclosure is adapted to be connected to said first moulded end member.

Preferably, in the above said method, either said first or second moulded member is formed with a transversal aperture and a grid of partitioning ridges are formed within the aperture for connecting to the partitioning strap.

Preferably, in the said method, said partitioning straps are substantially taut when the said first intermediate sub-assembly has been fully erected and the straps duly attached to both the first moulded member and the intermediate member.

According to a second aspect of the present invention, there is provided a golf bag which includes a first moulded end member, a second moulded end member, an intermediate member, a plurality of substantially rigid stay members supporting said top collar member from said intermediate bottom member, at least a flexible partitioning strap extending between said intermediate member and said first moulded end member wherein said first and second moulded end members are at the longitudinal ends of said golf bag and wherein said intermediate member is placed intermediate between said stay members and said first moulded end member.

Preferably, said first moulded end member is the top collar member of said golf bag.

According to a third aspect of the present invention, there is provided a golf bag which includes a first and a second substantially rigid moulded end members disposed at the longitudinal ends wherein said golf bag includes a first and a second intermediate sub-assembly wherein said first intermediate sub-assembly includes a first moulded end member, an intermediate member, a plurality of substantially rigid stay members extending between said first moulded member and said intermediate member and at least a flexible partitioning strap between said first moulded end member and said intermediate member, and said second intermediate sub-assembly includes a second moulded end member and an enclosure having a first and a second longitudinal open ends wherein said first open end of said enclosure is connected to said second moulded member and said second end of said enclosure is adapted to be connected to said first moulded end member.

According to yet another aspect of the present invention, there is provided a golf bag having a substantially rigid top member, a substantially rigid bottom member, a plurality of rigid stays separating said top and bottom members, an outer cover and at least one internal partitioning member including at least one intermediate member attached to one end of said plurality of stays and at least one internal partitioning member, said at least one intermediate member attached to either said top or bottom member, and a distal end of said plurality of stays and said at least one internal partitioning member from said at least are intermediate member attached directly, or indirectly, the bottom or top member respectively. .

BRIEF DESCRIPTION OF THE DRAWINGS

Preferred embodiments of the present invention will now be explained in more details by way of examples and with reference to the accompanying drawings, in which.

DETAILED DESCRIPTION OF THE PREFERRED EMBODIMENTS

Figure 1:
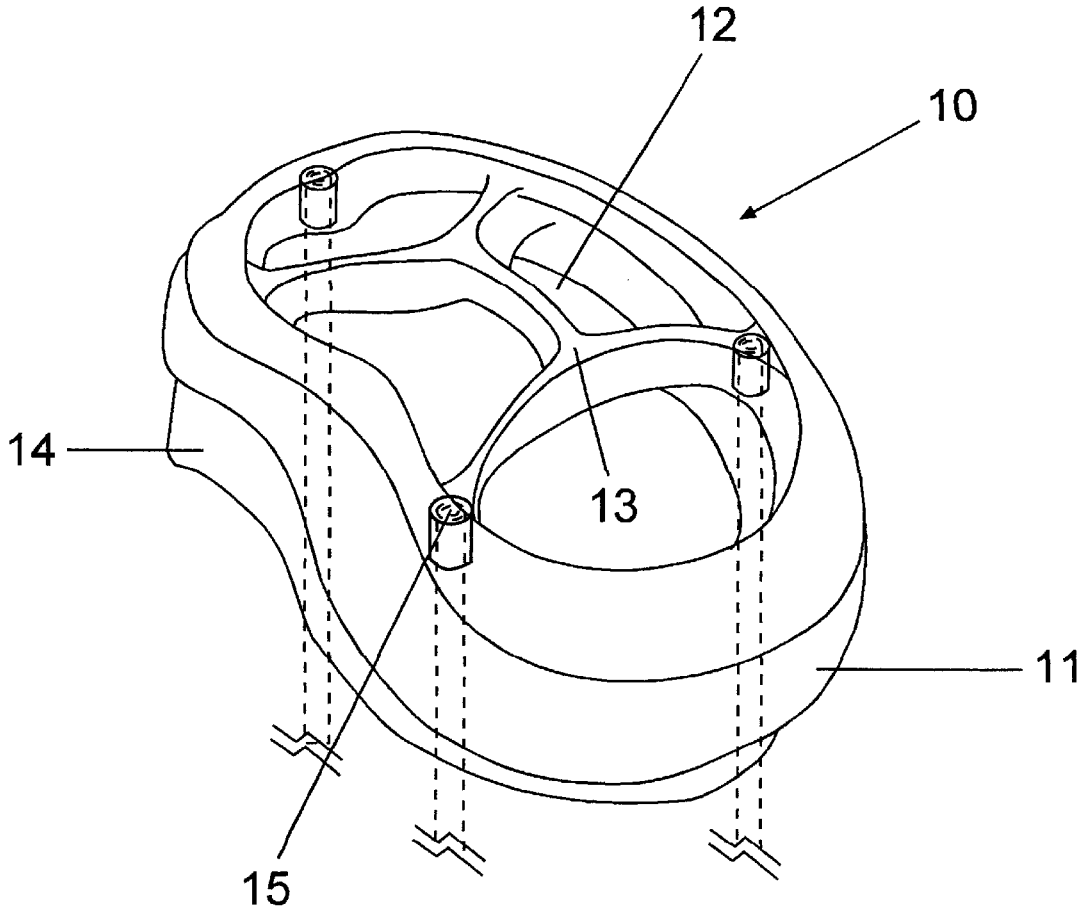
FIG. 1 is a perspective view showing the top moulded member of a typical partitioned golf bag.

Referring to FIG. 1, there is shown a substantially rigid moulded top collar member (10) of a conventional golf bag. A conventional golf bag is elongate and has a first and second rigid moulded ends disposed at its longitudinal ends which are referred interchangeably to as the top collar member and the bottom member in the present specification including the claims. The top collar (10) has a peripheral wall (11) which approximately defines the transversal shape of a golf bag and which defines the golf club receiving aperture (12) of a golf bag. A grid of ridges (13) corresponding to the compartmental walls of a partitioned golf bag is provided within the aperture. A plurality of stay channels (15) for receiving stay members are provided on the underneath of the top collar member. The top collar member (10) also includes a neck portion (14) which extends underneath and beyond the outside peripheral wall (14) of the top collar member (10) for connection to one end of the enclosure member (40) of the golf bag.

Figure 2:
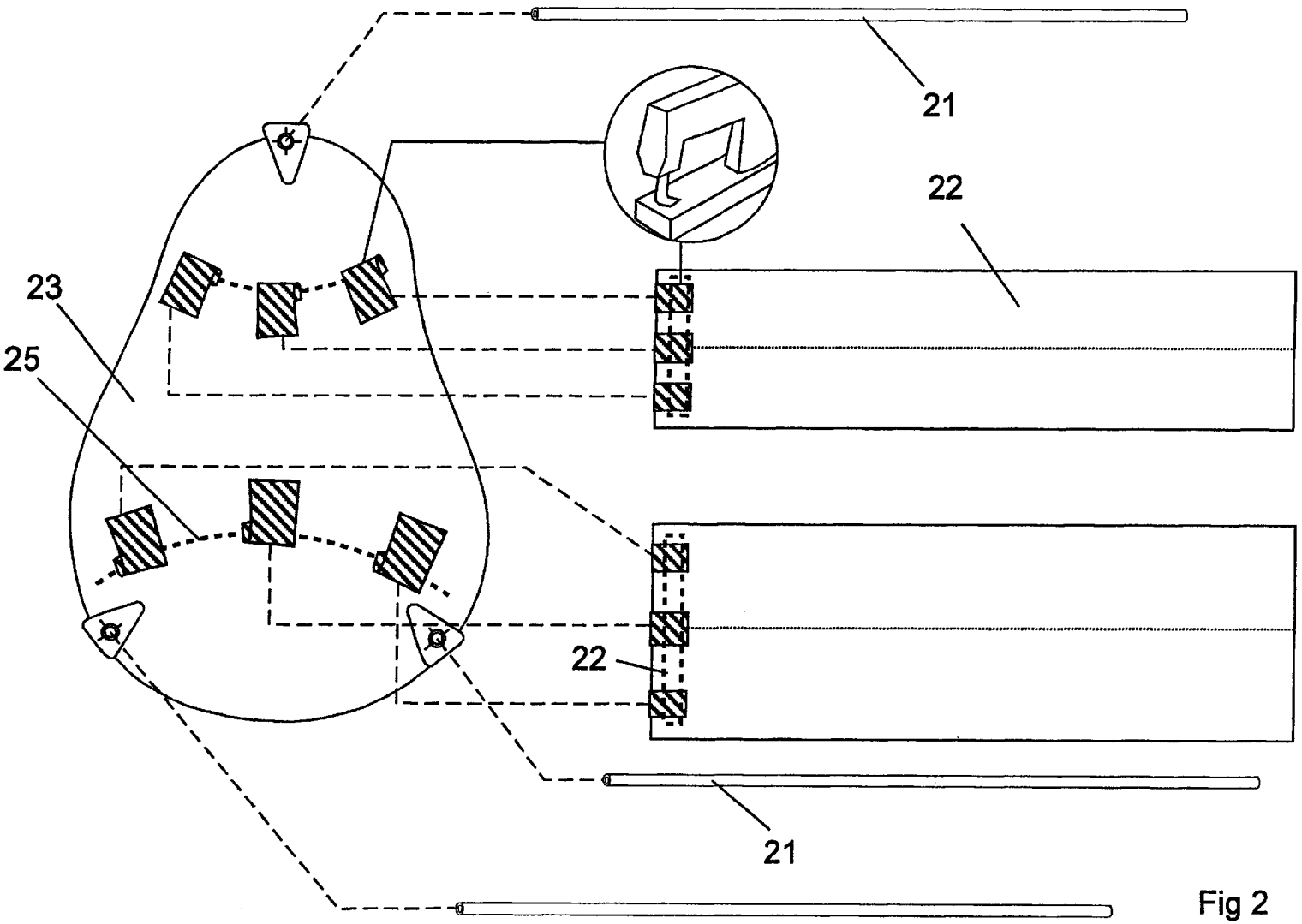
FIG. 2 is a dis-assembled drawing showing the intermediate bottom member, the stay members and the partitioning straps.
Figure 3:
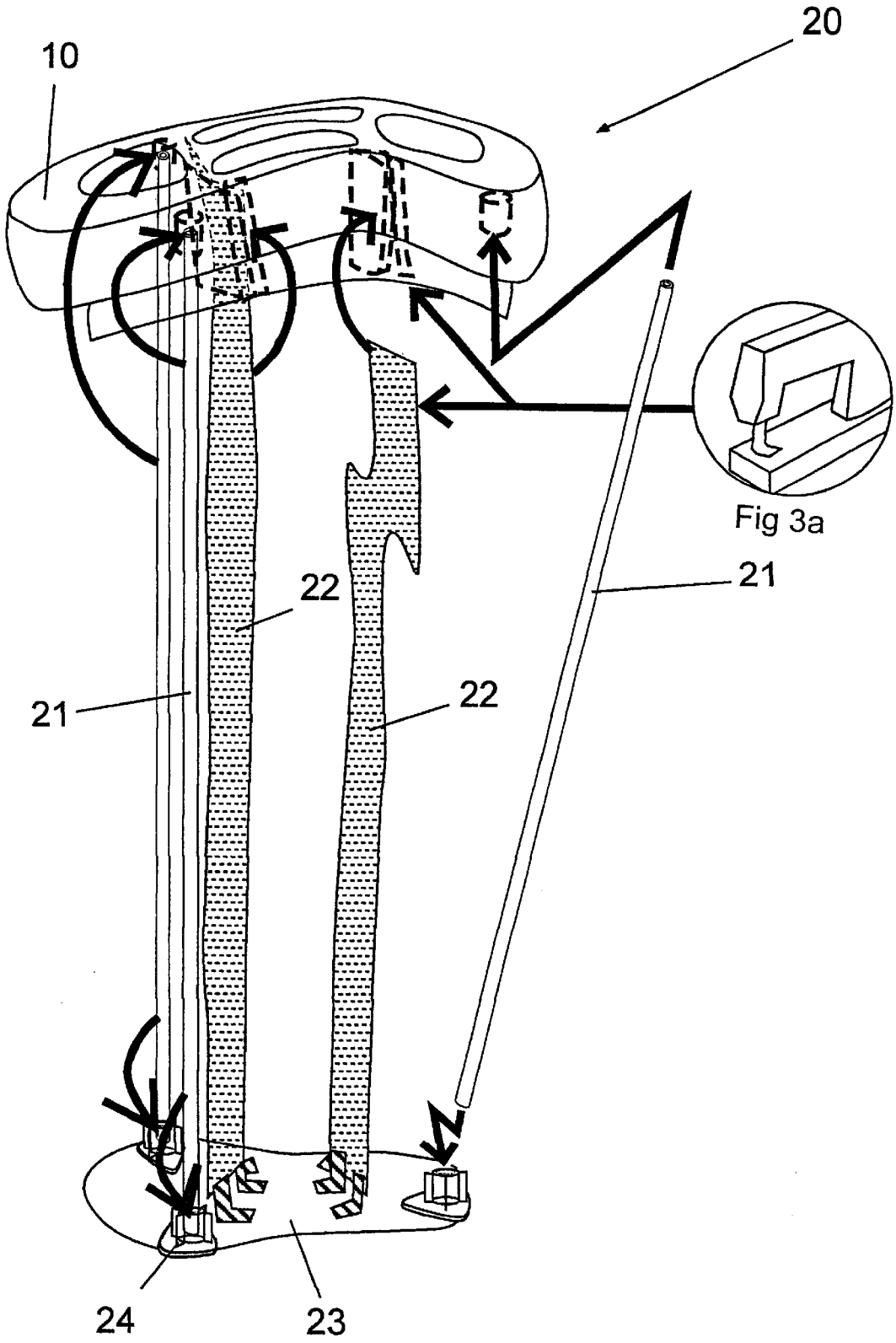
FIG. 3 is a schematic diagram showing a semi-finished first intermediate sub-assembly for the first preferred embodiment.
Figure 4:
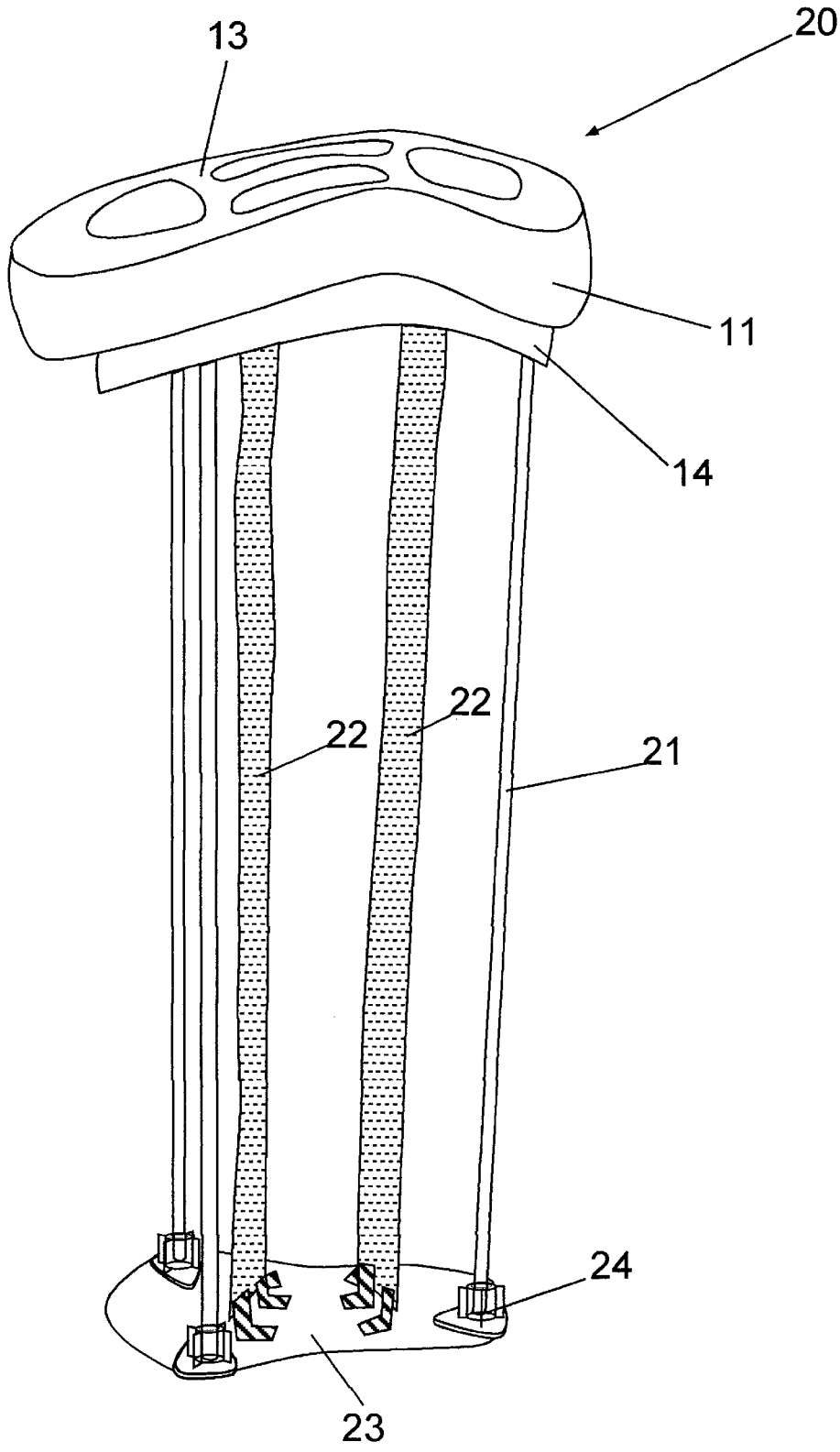
FIG. 4 is a schematic diagram showing a completed first intermediate sub-assembly in the first preferred embodiment.

Referring to FIGS. 2–4, there is shown a first intermediate sub-assembly (20) of a first preferred embodiment of the present invention. The first intermediate sub-assembly (20) includes the rigid moulded top collar member (10), a plurality of stay members (21), at least a flexible partitioning or divider strap (22) and an intermediate bottom member (23) having also a plurality of stay channels disposed on its upper surface and corresponding to the stay channels formed on the underneath of the top collar member.

Referring to FIG. 2, the intermediate bottom member (23) is preferably a substantially rigid plate shaped so as to be received by or within the bottom moulded member (30). A plurality of stay channels, stay fastening or receiving means (24) are formed preferably along the edges of the periphery of the intermediate bottom-member (23) and corresponding to the positions of the stay channels (15) formed underneath the top collar member (10). The dotted curve lines (25) shown on the intermediate bottom member (23) are indicative or illustrative of the vertical projections of the ridges (13) of the top collar member (10) on the intermediate bottom member. To form the partitions or compartments within the golf bag, a free end of the partitioning or divider straps is to be attached to the intermediate bottom member (23) along the curved dotted lines to conform with the curvature of the corresponding partitioning ridge (13) of the top collar member (10). The attachment can for example be by sewing, stitching, riveting, or other fastening means. In order that the partitioning or divider straps remain taut after they have been properly mounted, the straps can be made of an elastic material or an elastic member can be sewn onto the straps. To alleviate the more salient shortcoming associated with the first commonly known method, namely, the unsightly gaps between individual cushioning members wrapped on the ridges, it is preferred that the present top collar member is pre-wrapped with a cushioning member which is substantially continuous with minimal gaps between the branches of the partitioning ridges. After the partitioning straps have been secured onto the intermediate bottom member (23), the other free ends of the partitioning straps are then connected to the top collar member by attaching to the cushioning member or other appropriate positions underneath the partitioning ridges on the top collar member. At this point, stay members are inserted into the stay channels (15, 24) underneath the top collar member and also in the corresponding stay member receiving means on the intermediate bottom member (23) to form an erected structure of the first intermediate sub-assembly of the golf bag as shown in FIG. 4.

Figures 5, 5A:
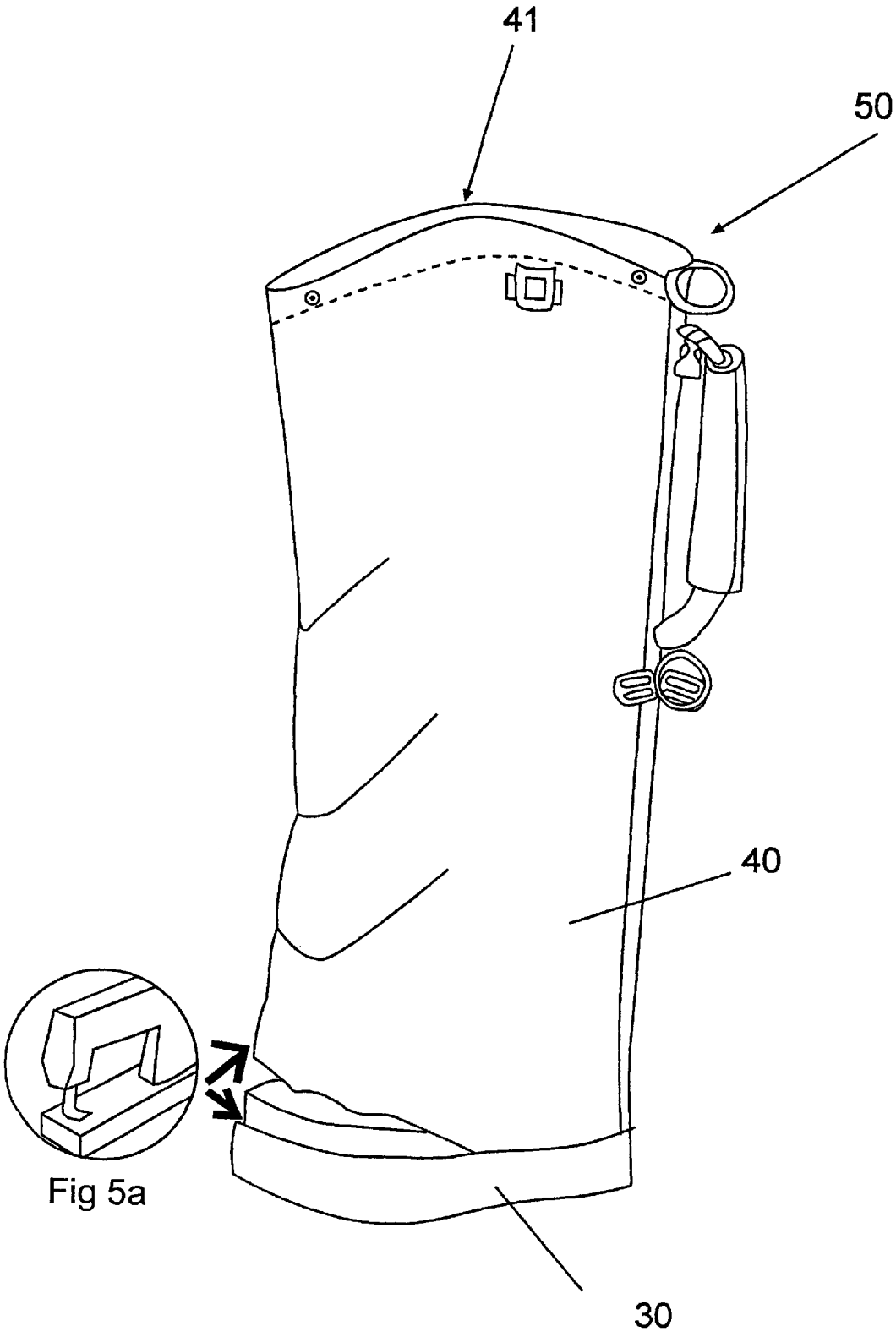
FIG. 5 shows the second intermediate sub-assembly of the first preferred embodiment.

Referring to FIG. 5, there is shown a second intermediate sub-assembly (50) of the present preferred embodiment including a moulded bottom member (30) and an enclosure (40) which is usually designed or adapted to enclose the whole of the space between the top collar member (10) and the moulded bottom member (30). The moulded bottom member (30) is usually formed to correspond to the transversal shape of the top collar member (10) and is provided to receive and support the handles of golf clubs to be stored within the golf bag. The enclosure (40) is usually made of a flexible and light material for easy and comfortable transport. The bottom of the enclosure is usually fastened to the top part of the bottom moulded member by, for example, sewing, stitching, riveting, or other fastening methods. The top part (41) of the enclosure remains open and is sized to receive the intermediate bottom member (23) together with the erected stay structure of the first intermediate sub-assembly (20).

Figure 6:
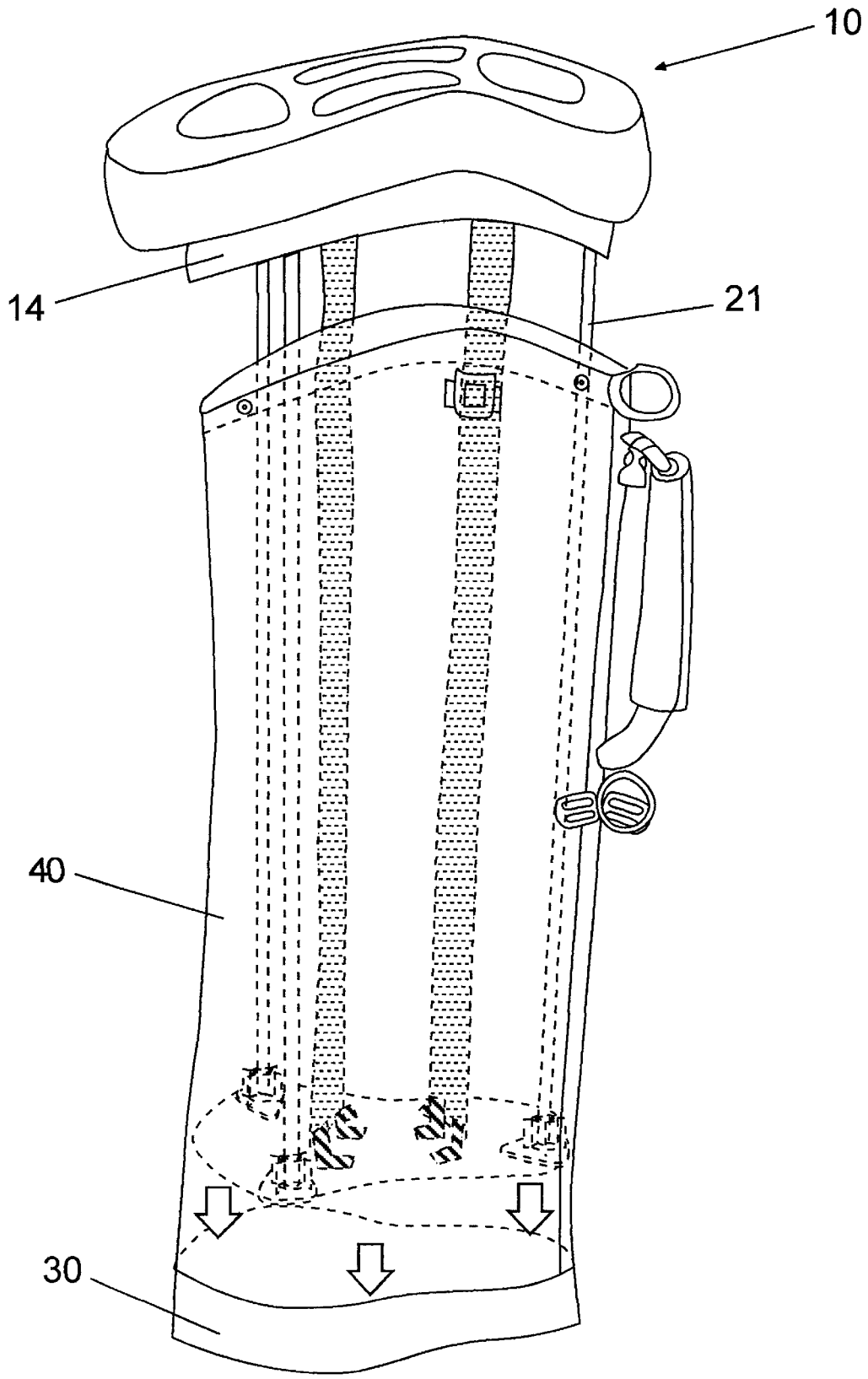
FIG. 6 shows a transitional semi-finished golf bag including the first and the second intermediate sub-assemblies.
Figure 7:
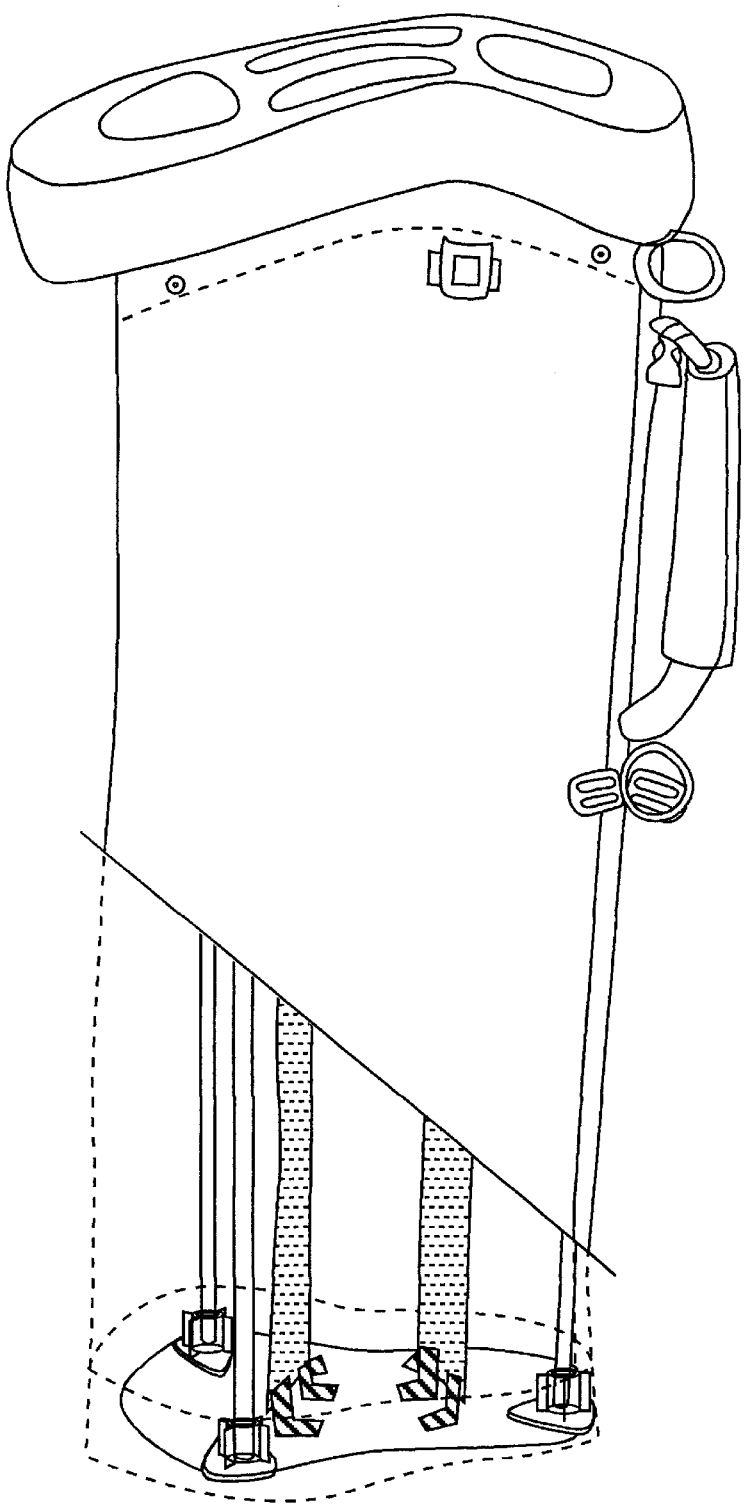
FIG. 7 is a partially exposed view of the final assembly of the intermediate assembly of FIG. 6 with the first and the second intermediate sub-assemblies joining together.

Referring now to FIG. 6, there is shown a transitional assembly including the first (20) and the second (50) intermediate sub-assemblies in which the first intermediate sub-assembly is almost wholly received within the fully expanded enclosure. After the first intermediate sub-assembly (20) has been received within the second intermediate sub-assembly, the two sub-assemblies are fastened or connected together, for example, by fastening, for exam pie, by sewing, riveting, or stitching, the top edge of the enclosure to the bottom (10) or the neck portion of the top collar member.

With the formation of these two intermediate sub-assemblies, it will be appreciated that the making of a partitioned golf bag is simpler and easier compared to the conventional methods mentioned above and the manufacturing process is more controllable and less skill dependent as there will be less unpredictable procedures involved in, for example, finding accurately and matching the temporarily alignment positions in method two above.

Hence, by providing a first intermediate sub-assembly which includes a top collar member, an intermediate bottom member and flexible partitioning straps which are fully expanded by the fully erected stay members which are disposed around the periphery of the intermediate bottom member and between the top collar member and the intermediate bottom member, the making of a partitioned golf bag is made much simpler and production costs would be significantly reduced. It also follows that the production time will also be significantly reduced to benefit general consumers.

In a second preferred embodiment of the present invention (not shown in Figures), the golf bag is also formed by combining and fastening a first and a second intermediate sub-assemblies. The first intermediate sub-assembly includes a top moulded collar member and an enclosure which is fastened to the top collar member by, for example, sewing, riveting, or stitching to the lower periphery of the top collar member. The second intermediate sub-assembly includes a bottom moulded member, an intermediate top member, a plurality of stay members extending between the intermediate top member and the moulded bottom member and supporting the intermediate top member from the bottom moulded member and at least a partitioning or divider strap extending between the intermediate top member and the moulded bottom member. Preferably, the strap dividers are taut when they are properly mounted between the two members. The complete golf bag is stand completely assembled by inserting the enclosure which is connected to the top collar member to cover the erected stay structure and then connected to the upper periphery of the bottom moulded members.

In a third preferred embodiment of the present invention (also not shown in the Figures), there is provided a first intermediate sub-assembly which includes a top intermediate member, a bottom intermediate member, a plurality of stay members extending between the top and bottom intermediate members and supporting the top intermediate member from the bottom intermediate member. The top and bottom intermediate members are shaped and configured to be securely received inside the top collar member and bottom member respectively. At least a partitioning or divider strap extends between the top and bottom intermediate members and the strap is preferably taut when mounted on the intermediate members. This intermediate member will then be inserted into a second intermediate sub-assembly which includes an enclosure that is fastened to either the top collar or the bottom moulded member. The golf bag can be completed by connecting the semi-completed sub-assembly, which includes the first and second sub-assemblies connected, with the top collar member or the bottom member which has not been fastened to the enclosure.

While the present invention has been explained by reference to preferred methods of making a partitioned golf bag, it will be appreciated that the specific examples used herein is for illustration only and other equivalent or similar methods can be utilised to achieve the same result without affecting the scope and ambit of the present invention. In particular, it will be appreciated that an aspect of the present invention is characterised by a partitioned golf bag in which there is provided an intermediate member which is placed between the top collar member and the moulded bottom member wherein the intermediate member is characterised by having a plurality of stay member receiving or fastening means together with means for receiving the ends of the partitioning or divider straps. Furthermore, while a plurality of partitioned straps are usually provided in a partitioned golf bag, it is also possible that only a single partitioning strap is provided for the compartmentalisation of a golf bag.

What is claimed is:

1. A method of making a golf bag, said golf bag including first and second substantially rigid moulded end members disposed at its longitudinal ends, an intermediate member disposed between said first and second rigid moulded members, a plurality of substantially rigid stay members and at least one flexible partitioning strap extending between said first moulded member and said intermediate member, and an enclosure having first and second longitudinal open ends fastened respectively to said second and first rigid moulded members, said first moulded end member being provided with integral means for receiving said stay members, the method including the steps of:

forming a first intermediate sub-assembly by connecting said plurality of stay members and said flexible partitioning strap to said first rigid moulded end member and said intermediate member, forming a second intermediate sub-assembly by fastening said enclosure to said second rigid moulded end member, inserting said first intermediate sub-assembly into said second intermediate sub-assembly by moving said intermediate member of said first intermediate sub-assembly into said enclosure and towards said second rigid moulded member, and fastening said second end of said enclosure to said first rigid end member.

2. A method of making a golf bag according to claim 1, further including the step of fastening said second end of said enclosure to said first moulded end member such that said second end of said enclosure and said first moulded end member are not rotatable relative to each other.

3. A method of making a golf bag according to claim 2, further including the step of applying a cushioning material to said first rigid moulded member before forming said first intermediate sub-assembly.

4. A method of making a golf bag according to claim 1, wherein said flexible partitioning strap is fastened to said intermediate member and said first rigid moulded end member before said stay members are connected to said intermediate member and said first rigid moulded member.

5. A method of making a golf bag according to claim 1, wherein said intermediate member has a non-circular outline and said second rigid moulded member has a cavity with a complementarily shaped inside contour, the method further including the step of aligning said intermediate member with the complementarily shaped cavity during insertion of said first intermediate sub-assembly into said second intermediate sub-assembly so that said intermediate member is non-rotatably received by said second rigid moulded member.

6. A method according to claim 1, wherein either said first or second moulded member is formed with a transversal aperture having an integrally formed grid of partitioning ridges for connecting to said partitioning strap, said intermediate member has a non-circular outline adapted to be received by or within said second rigid moulded end member so that said intermediate member and said second moulded member are not relatively rotatable when assembled, said method further including inserting said first intermediate sub-assembly into said second intermediate sub-assembly until said intermediate member is non-rotatably received by or within said second rigid moulded end member.

7. A method according to claim 1, wherein said partitioning strap is substantially taut and said plurality of stay members surround said partitioning strap when said first intermediate sub-assembly has been assembled, the method including the further step of tightening said partitioning strap in the formation of said first intermediate sub-assembly by connecting said plurality of stay members which are long enough to tighten said partitioning strap between said first rigid moulded member and said intermediate member after said flexible partitioning strap has been attached.

8. A method according to claim 1, wherein a corresponding plurality of stay-receiving or stay-fastening means are provided on said intermediate member and said first moulded end member, said corresponding plurality of stay-receiving or stay-fastening means being disposed so that said plurality of stay members are generally parallel and spaced apart when assembled, wherein the step of forming said first intermediate sub-assembly includes the steps of aligning said intermediate member and said first moulded end member, and fastening said plurality of stay members to said stay-receiving or stay-fastening means so that said stay members are generally parallel and spaced apart.

9. A golf bag made by the method of claim 1, wherein, said intermediate member of said golf bag is disposed between said first and second rigid moulded end members, is not fastened to said second rigid moulded end member, and is not rotatable relative to said second rigid moulded member.

10. A golf bag made by the method of claim 2, wherein, said intermediate member has a non-circular outline, said second rigid moulded end member has a correspondingly shaped cavity and said intermediate member is non-rotatably received by or within said correspondingly shaped cavity.

11. A golf bag made by the method of claim 3, wherein, said intermediate member, said first rigid moulded end member and said intermediate member include integrally formed channels for receiving said plurality of stay members and said first rigid moulded end member is wrapped with said cushioning material.

12. A golf bag including a first moulded end member, a second moulded end member, an intermediate member, at least a flexible partitioning strap extending between said intermediate member and said first moulded end member, a plurality of substantially rigid stay members supporting said first moulded end member from said second moulded end member, said first moulded end member being provided with integral means for receiving said stay members, an enclosure surrounding said plurality of stay members and connecting said first and said second moulded end members, said first and second moulded end members being at the longitudinal ends of said golf bag, said intermediate member being disposed intermediate between said stay members and said second moulded end member, and said intermediate member having a non-circular outline and being received by a correspondingly shaped cavity of said second rigid moulded member.

13. A golf bag according to claim 12, wherein said first moulded end member constitutes a top collar member of said golf bag, said top collar member being integrally formed with a grid of partitioning ridges and wrapped with a cushioning material.

14. A golf bag according to claim 12, wherein said bottom moulded member constitutes a bottom member of said golf bag, said bottom moulded member being integrally formed with a cavity corresponding to the outline of said intermediate member.

15. A golf bag according to claim 12, wherein said first moulded end member is fastened to said second moulded end member by said enclosure that is made of flexible fabrics and said flexible partitioning strap is fastened to said intermediate member on the surface from which said stay members extend.

16. A partitioned golf bag having first and second substantially rigid moulded end members disposed at the longitudinal ends, said golf bag including a first and a second intermediate sub-assembly wherein:

said first intermediate sub-assembly includes said first moulded end member, an intermediate member, a plurality of rigid stay members extending between said first moulded member and said intermediate member and at least a flexible partitioning strap between said first moulded end member and said intermediate member, said first rigid moulded end member being integrally formed with means for receiving said stay members, and said second intermediate sub-assembly includes said second moulded end member and an enclosure having first and second longitudinal open ends wherein said first open end of said enclosure is connected to said second moulded member, said second moulded end member includes a cavity having a shape corresponding to the non-circular outline of said intermediate member, wherein, in the assembled golf bag, said second end of said enclosure is fastened to said first moulded end member, said intermediate member of said first intermediate sub-assembly is disposed intermediate said stay members and said second moulded end member, said plurality of stay members support said enclosure from said second moulded end member, and said intermediate member is non-rotatably received in the corresponding shaped cavity of said second moulded member.

* * * * *